US008243005B2

(12) United States Patent
Oh et al.

(10) Patent No.: US 8,243,005 B2
(45) Date of Patent: Aug. 14, 2012

(54) APPARATUS AND METHOD FOR DRIVING LAMP OF LIQUID CRYSTAL DISPLAY DEVICE

(75) Inventors: Eui Yeol Oh, Yongin-si (KR); Hee Jung Hong, Seoul (KR); Hee Jeong Park, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 1237 days.

(21) Appl. No.: 11/137,631

(22) Filed: May 25, 2005

(65) Prior Publication Data

US 2005/0264516 A1 Dec. 1, 2005

(30) Foreign Application Priority Data

May 27, 2004 (KR) ..... 10-2004-0037768

(51) Int. Cl.
*G09G 3/36* (2006.01)

(52) U.S. Cl. ..... 345/102

(58) Field of Classification Search ..... 345/102; 349/61–70; 362/561
See application file for complete search history.

(56) References Cited

U.S. PATENT DOCUMENTS

| | | | | |
|---|---|---|---|---|
| 6,636,190 | B2 * | 10/2003 | Hirakata et al. | 345/74.1 |
| 6,795,053 | B1 * | 9/2004 | Funamoto et al. | 345/102 |
| 2003/0016205 | A1 * | 1/2003 | Kawabata et al. | 345/102 |

FOREIGN PATENT DOCUMENTS

| | | |
|---|---|---|
| CN | 1498052 | 5/2004 |
| JP | 10-162988 | 6/1998 |
| JP | 2000-321571 | 11/2000 |
| JP | 2002-055657 | 2/2002 |
| KR | 10-2001-0082949 | 8/2001 |
| KR | 10-2002-0029296 | 4/2002 |
| KR | 10-0337111 | 5/2002 |
| KR | 10-2003-0009190 | 1/2003 |
| TW | 529236 | 4/2003 |
| TW | 568503 | 12/2003 |

OTHER PUBLICATIONS

Office Action issued in corresponding Japanese Patent Application No. 2005-153435; mailed Apr. 30, 2008.
Office Action issued in corresponding Taiwanese Patent Application No. 094117589; issued Jul. 21, 2008.
Office Action issued in corresponding Korean Patent Application No. 10-2004-0037768, mailed Feb. 28, 2011.

* cited by examiner

*Primary Examiner* — Chanh Nguyen
*Assistant Examiner* — Ram Mistry
(74) *Attorney, Agent, or Firm* — Brinks Hofer Gilson & Lione

(57) ABSTRACT

A driving apparatus and method are presented to drive lamps that irradiate a liquid crystal display panel of a liquid crystal display device. A picture implementing period, during which a picture is implemented by the liquid crystal display device, and a shorter, scanning period before the picture implementing period are established. An output power supplied to the lamps to set a reference brightness is determined. A lamp driver changes a duty ratio and/or an amplitude of an AC signal supplied to the lamps to establish the reference brightness during the scanning period. The duty ratio/amplitude of the AC signal is adjusted dependent on the characteristics of the liquid crystal material in the liquid crystal display.

14 Claims, 11 Drawing Sheets

APPARATUS AND METHOD FOR DRIVING LAMP OF LIQUID CRYSTAL DISPLAY DEVICE

This application claims the benefit of Korean Patent Application No. P2004-37768 filed in Korea on May 27, 2004, which is hereby incorporated by reference.

FIELD OF THE INVENTION

The present invention relates to an apparatus and a method for luminance control of liquid crystal display device, and more particularly, to an apparatus and a method for driving a lamp of liquid crystal display device that is capable of improving picture quality and of stably representing brightness.

DESCRIPTION OF THE RELATED ART

In general, the number of applications in which liquid crystal displays (hereinafter, LCDs) are used have been increasing due to the lightness, thinness, and low power consumption of the LCDs. For example, LCDs are used in office automation devices, audio/video devices and the like. The LCD adjusts transmittance of light therethrough dependent on an image signal applied to a matrix of a plurality of control switches to thereby display desired pictures in a screen.

Since the LCD is not a spontaneous light-emitting display device, the LCD device needs a back light unit as a light source. There are two types of back light units for the LCD, i.e., a direct-below-type and a light guide plate-type. In the direct-below-type, several lamps are arranged directly below the display. A diffusion panel is installed between the lamp and the liquid crystal display panel to maintain the distance between the liquid crystal display panel and the lamp. In the light guide plate-type, the lamp is installed in the outer part of the flat panel, and light is incident to the whole surface of the liquid crystal display panel from a lamp by use of a transparent light guide plate.

Referring to FIGS. 1 and 2, the LCD adopting a related art direct-below-type backlight includes a liquid crystal display panel 2 to display a picture, and a direct-below-type backlight assembly to irradiate uniform light onto the liquid crystal display panel 2.

In an active matrix type liquid crystal display panel 2, liquid crystal cells are arranged between an upper substrate and a lower substrate, and a common electrode and pixel electrodes apply an electric field to each of the liquid crystal cells. Each of the pixel electrodes is connected to a thin film transistor that is used as a switching device. The pixel electrode drives the liquid crystal cell along with the common electrode in accordance with a data signal supplied through the thin film transistor, thereby displaying a picture corresponding to a video signal. To implement a picture, the liquid crystal display panel 2 has an inherent delay time to activate the liquid crystal material to transmit light.

The direct-below-type backlight assembly includes: a lamp housing 34, a reflection sheet 14 stacked on a front surface of the lamp housing 34, a plurality of lamps 36 located at an upper part of the reflection sheet 14; a diffusion plate 12; and optical sheets 10.

The lamp housing 34 prevents light leakage from the lamps 36 and reflects light progressing to the side surface and the rear surface of the lamps 36, to the front surface, i.e., toward the diffusion plate 12, thereby improving the efficiency of the light generated at the lamps 36.

The reflection sheet 14 is arranged between the lamps 36 and the upper surface of the lamp housing 34 to reflect the light generated from the lamps 36 so as to irradiate toward the liquid crystal display panel 2, thereby improving the efficiency of light.

Each of the lamps 36 includes a glass tube, an inert gas in the inside of the glass tube, and a cathode and an anode installed at both ends of the glass tube. The inside of the glass tube is charged with the inert gas, and the phosphorus is spread over the inner wall of the glass tube.

In each of the lamps 36, if an alternating current AC waveform of high voltage is applied to a high voltage electrode and a low voltage electrode from an inverter (not shown), electrons are emitted from the low voltage electrode L to collide with the inert gas of the inside of the glass tube, thus the amount of electrons are increased in geometrical progression. The increased electrons cause electric current to flow in the inside of the glass tube, so that the inert gas is excited by the electron to emit ultraviolet radiation. The ultraviolet radiation collides with phosphorus spread over the inner wall of the glass tube to emit visible radiation.

In this way, the lamps 36 are arranged in parallel on the lamp housing 34. The lamps 36 are arranged on the lamp housing 34 in the same manner as the high voltage electrode and the low voltage electrode.

The diffusion plate 12 enables the light emitted from the lamps 36 to progress toward the liquid crystal display panel 2 and to be incident in a wide range of angles. The diffusion plate 12 contains a light diffusion member coated on both sides of a film of transparent resin.

The optical sheets 10 narrow the viewing angle of the light coming out of the diffusion plate 12, thus improving the front brightness of the liquid crystal display device and reducing power consumption.

In this way, the related art LCD generates uniform light by use of the lamps 36 arranged in the lamp housing 34 to irradiate the light to the liquid crystal display panel 2, thereby displaying the desired picture. However, the related art LCD has disadvantages. For example, the lamps are continuously on, increasing the power consumption and preventing the peak brightness from being realized. The peak brightness is the brightness generated when a designated part on the liquid crystal display panel 2 is instantly brightened in order to display a picture like an explosion or a flash on the liquid crystal display panel 2. Moreover, to compensate for the delay time for activating the liquid crystal materials injected to the liquid crystal display panel 2, the brightness is deteriorated by supplying the same power irrespective of the character of the liquid crystal material.

SUMMARY OF THE INVENTION

By way of introduction only, in one aspect, apparatus for driving a lamp of a liquid crystal display device comprises: a plurality of lamps to irradiate light to a liquid crystal display panel and a lamp driver to change at least one of a duty ratio and an amplitude of an alternating current (AC) signal supplied to at least one of the lamps in accordance with a reference brightness of the liquid crystal display panel during a scanning period before a picture implementing period of the liquid crystal display panel such that the amplitude and the duty ratio of the AC signal correspond to display of the reference brightness.

In another embodiment, a method of driving a lamp of a liquid crystal display device includes setting at least one of a duty ratio and an amplitude of an alternating current (AC) signal supplied to the lamp in accordance with a reference brightness of a liquid crystal display panel during a scanning period before a picture implementing period of the liquid crystal display panel; and changing the at least one of the amplitude and the duty ratio of the AC signal in accordance with the duty ratio and the amplitude determined during the scanning period.

In another embodiment, a method of driving a plurality of lamps of a liquid crystal display device comprises: establishing a picture implementing period in which a picture is implemented by the liquid crystal display device and a scanning period before the picture implementing period, the scanning period being substantially less than the picture implementing period; determining an amount of power to be supplied to the lamp to establish a reference brightness; and adjusting at least one of an amplitude and a duty ratio of an alternating current (AC) signal supplied to the lamp to establish the reference brightness during the scanning period.

BRIEF DESCRIPTION OF THE DRAWINGS

The following detailed description of the embodiments reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 3 to 11.

Figure 1:
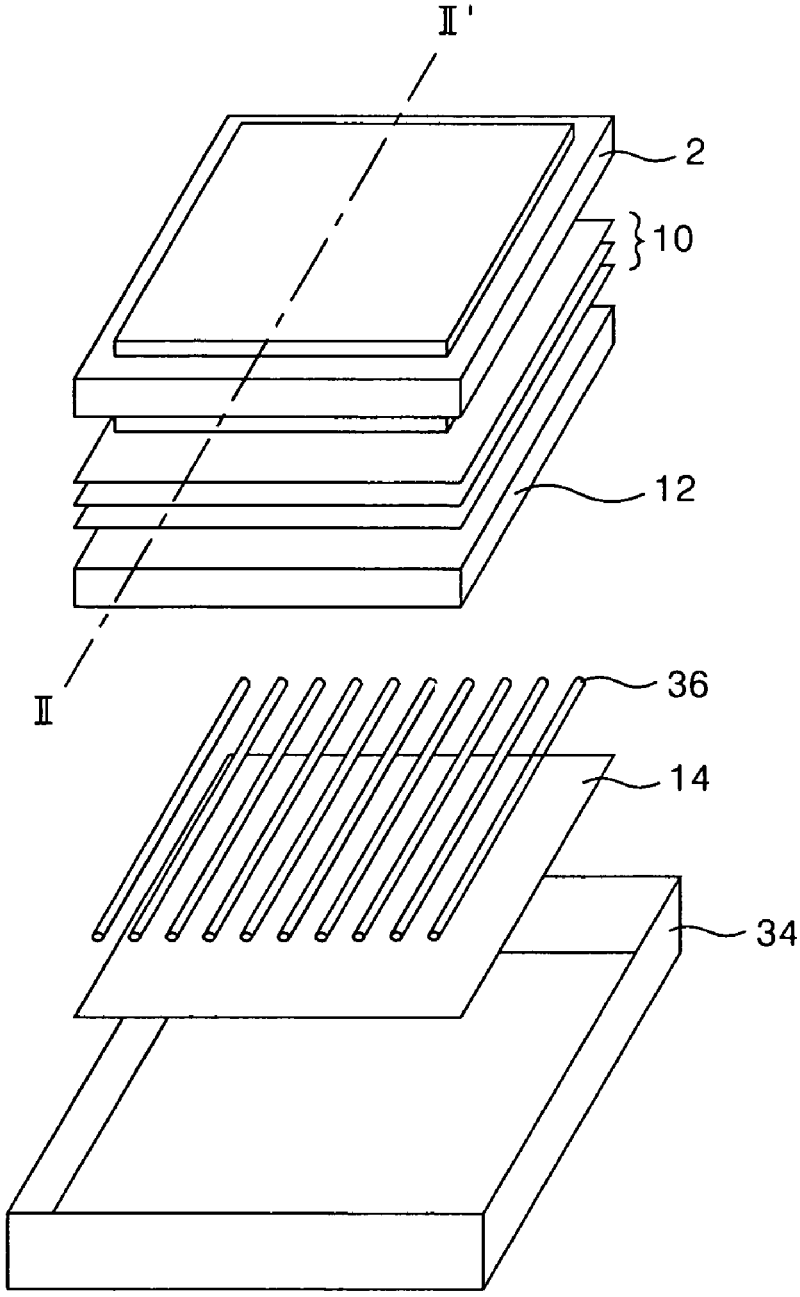
FIG. 1 RELATED ART
FIG. 1 is a perspective view illustrating a related art liquid crystal display device.
Figure 2:
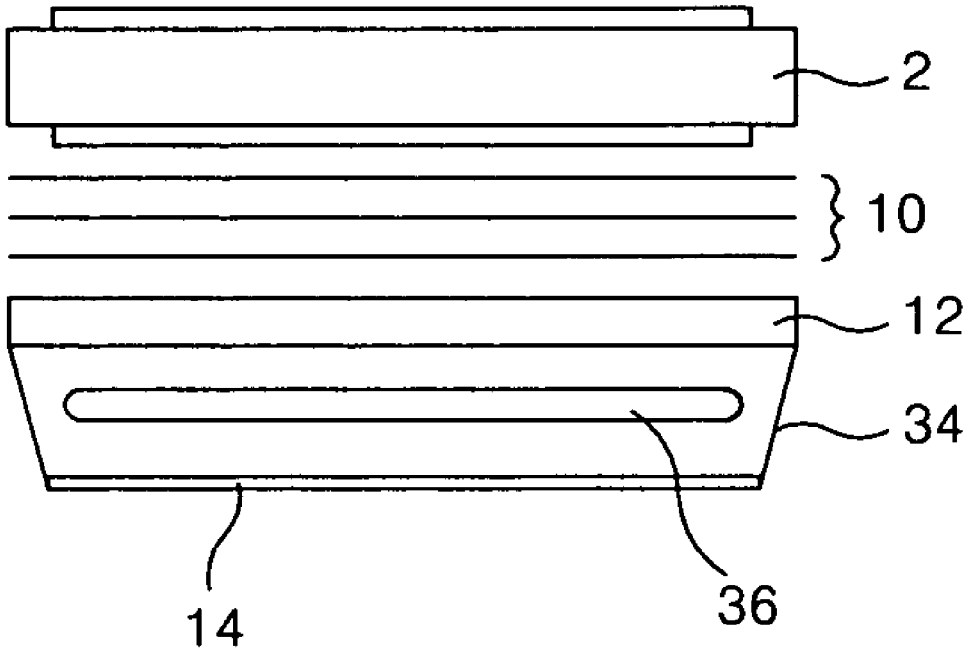
FIG. 2 RELATED ART
FIG. 2 is a sectional view illustrating the liquid crystal display device taken along the line II-II' in FIG. 1.
Figure 3:
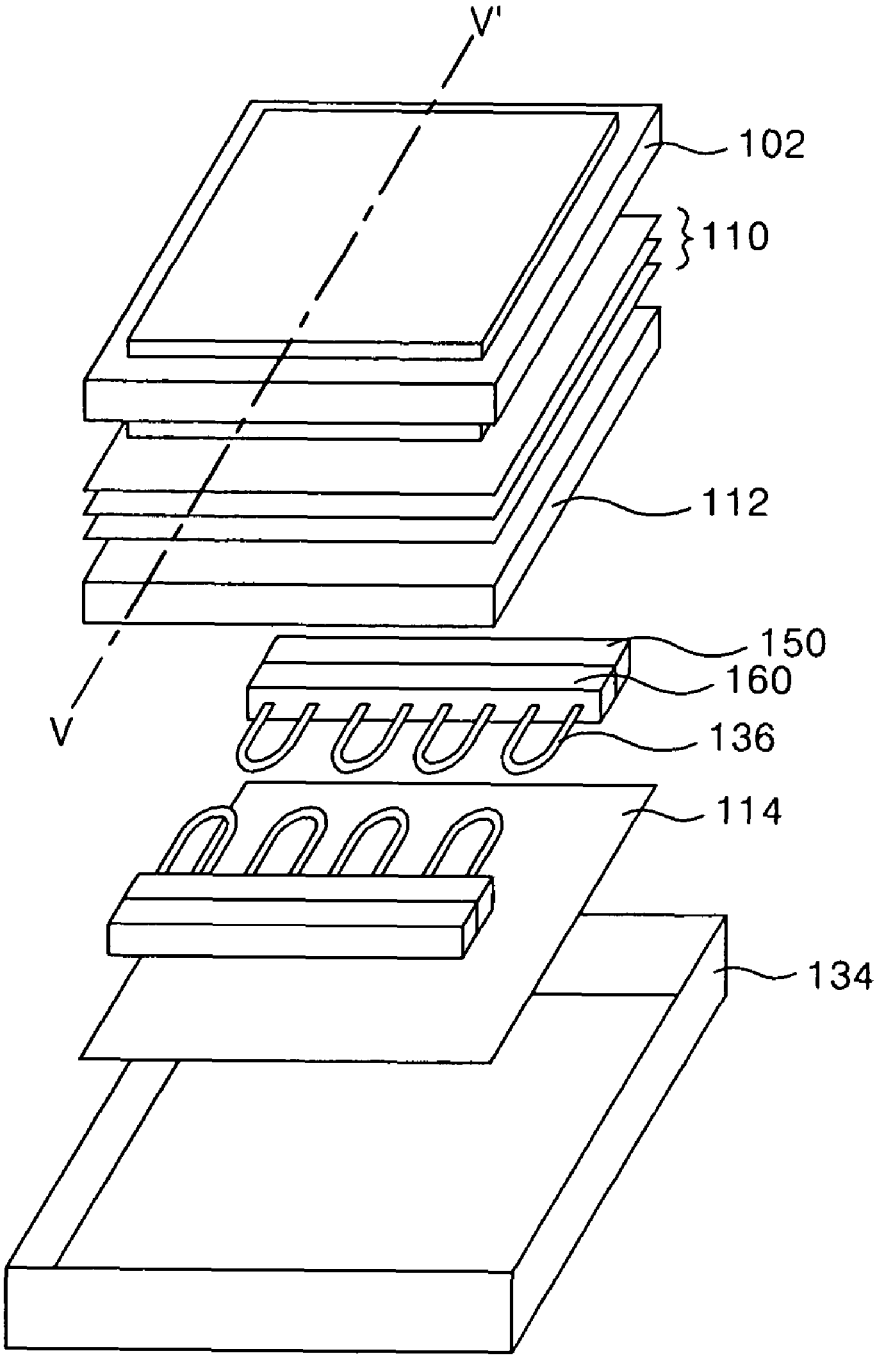
FIG. 3 is a perspective view illustrating a liquid crystal display device according to a first embodiment of the present invention.

FIG. 3 is a perspective view illustrating a liquid crystal display device according to a first embodiment of the present invention.

Referring to FIG. 3, a liquid crystal display device according to the first embodiment of the present invention includes: a liquid crystal display panel 102; a direct-below-type backlight assembly to irradiate light to the liquid crystal display panel 102; a lamp driver 160 to control driving of the direct-below-type backlight assembly; and a timing controller 150 to apply on/off signals corresponding to video data to the lamp driver 160.

Figure 4:
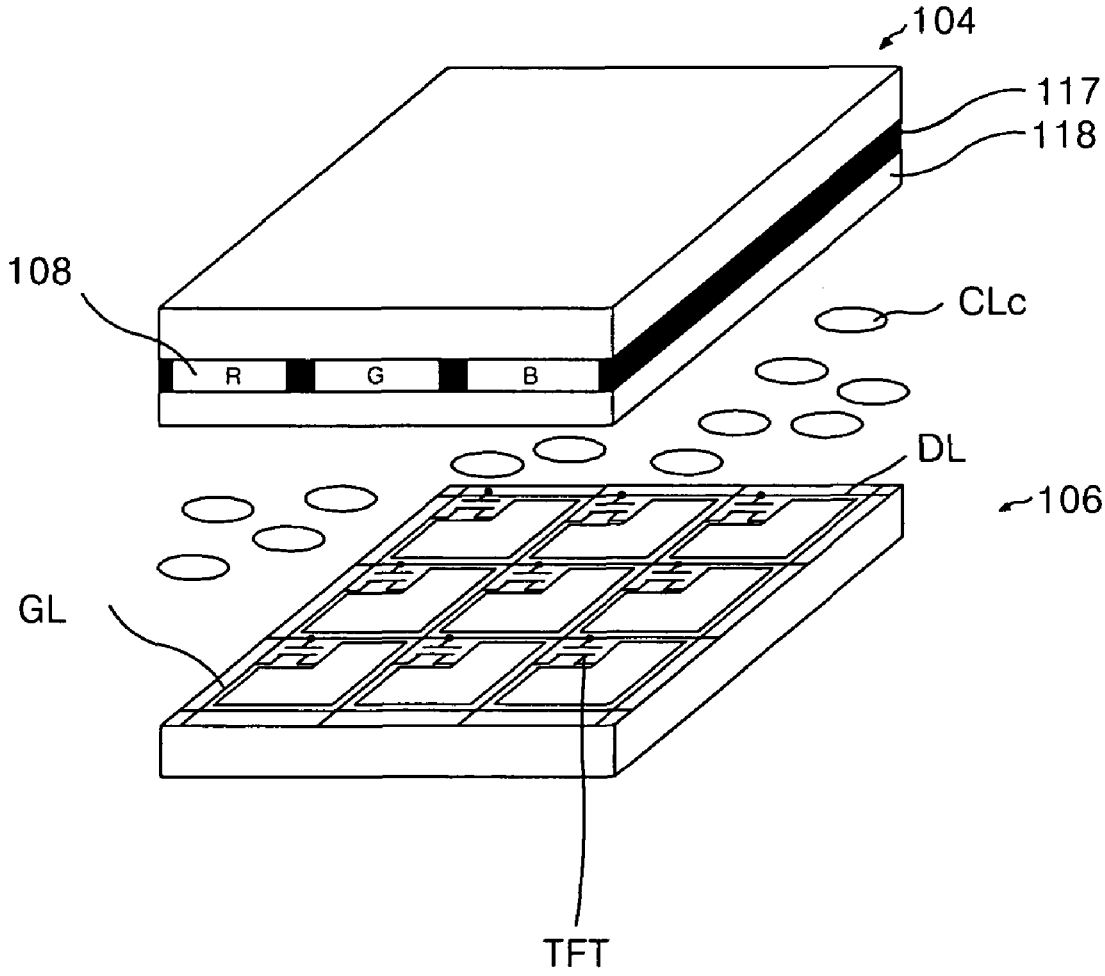
FIG. 4 is a disassembled perspective view illustrating a liquid crystal display panel in FIG. 3.

As shown in FIG. 4, the liquid crystal display panel 102 includes a liquid crystal material $CL_c$ injected between an upper substrate 104 and a lower substrate 106, and a spacer (not shown) for maintaining a gap of the upper substrate 104 and the lower substrate 106. On the upper substrate 104 of the liquid crystal display panel 102, a color filter 108, a common electrode 118, and a black matrix 117, etc. are formed. Further, the liquid crystal display panel 102 includes pixel electrodes and a thin film transistors TFT at each crossing of gate lines GL and data lines DL on the lower substrate 106.

Figure 5:
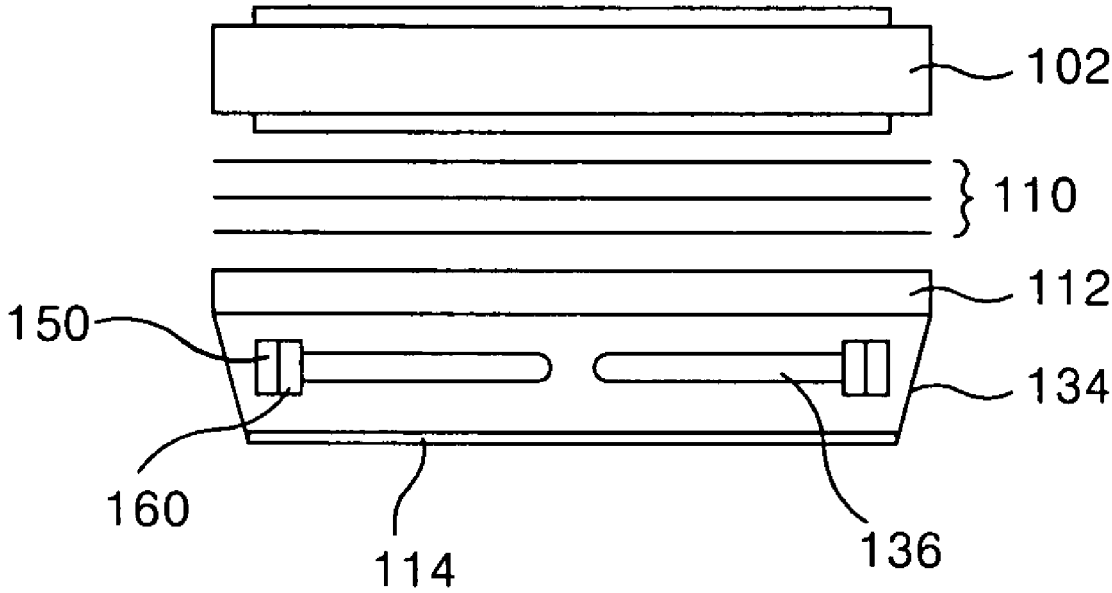
FIG. 5 is a sectional view illustrating the liquid crystal display panel taken along the line V-V' in FIG. 3.

The direct-below-type backlight assembly, as shown in FIG. 5, includes: a lamp housing 134; a reflection sheet 114 stacked on a front surface of the lamp housing 134; a plurality of lamps 136 stacked on an upper part of the reflection sheet 114 to generate light; a diffusion plate 112; and optical sheets 110 stacked on the diffusion plate 112.

The lamp housing 134 prevents light leakage from the lamps 136 and reflects light progressing to the side surface and the rear surface of the lamps 136 to the front surface, i.e., toward the diffusion plate 112, thereby improving the efficiency of the light generated at the lamps 136.

The reflection sheet 114 is arranged between the lamps 136 and the upper surface of the lamp housing 134 to reflect the light generated from the lamps 136 so as to irradiate it to a liquid crystal display panel 102 direction, thereby improving the efficiency of light.

Each of the lamps 136 includes a glass tube, an inert gas in the inside of the glass tube, and a cathode and an anode installed at both ends of the glass tube. The inside of the glass tube is charged with the inert gas, and phosphorus is spread over the inner wall of the glass tube.

In each of the lamps 136, if an AC waveform of high voltage is applied to a high voltage electrode and a low voltage electrode from an inverter (not shown), electrons are emitted from the low voltage electrode to collide with the inert gas of the inside of the glass tube, thus the amount of electrons are increased in geometrical progression. The increased electrons cause electric current to flow in the inside of the glass tube, so that the inert gas is excited by the electrons to emit ultraviolet radiation. The ultraviolet radiation collides with luminous phosphorus spread over the inner wall of the glass tube to emit visible radiation.

The diffusion plate 112 enables the light emitted from the lamps 136 to progress toward the liquid crystal display panel 102 and to be incident over a wide range of angles. The diffusion plate 112 contains a light diffusion member coated on both sides of a transparent resin film.

The optical sheets 110 narrow the viewing angle of the light coming out of the diffusion plate 112, thus it is possible to improve the front brightness of the liquid crystal display device and reduce power consumption.

Figure 6:
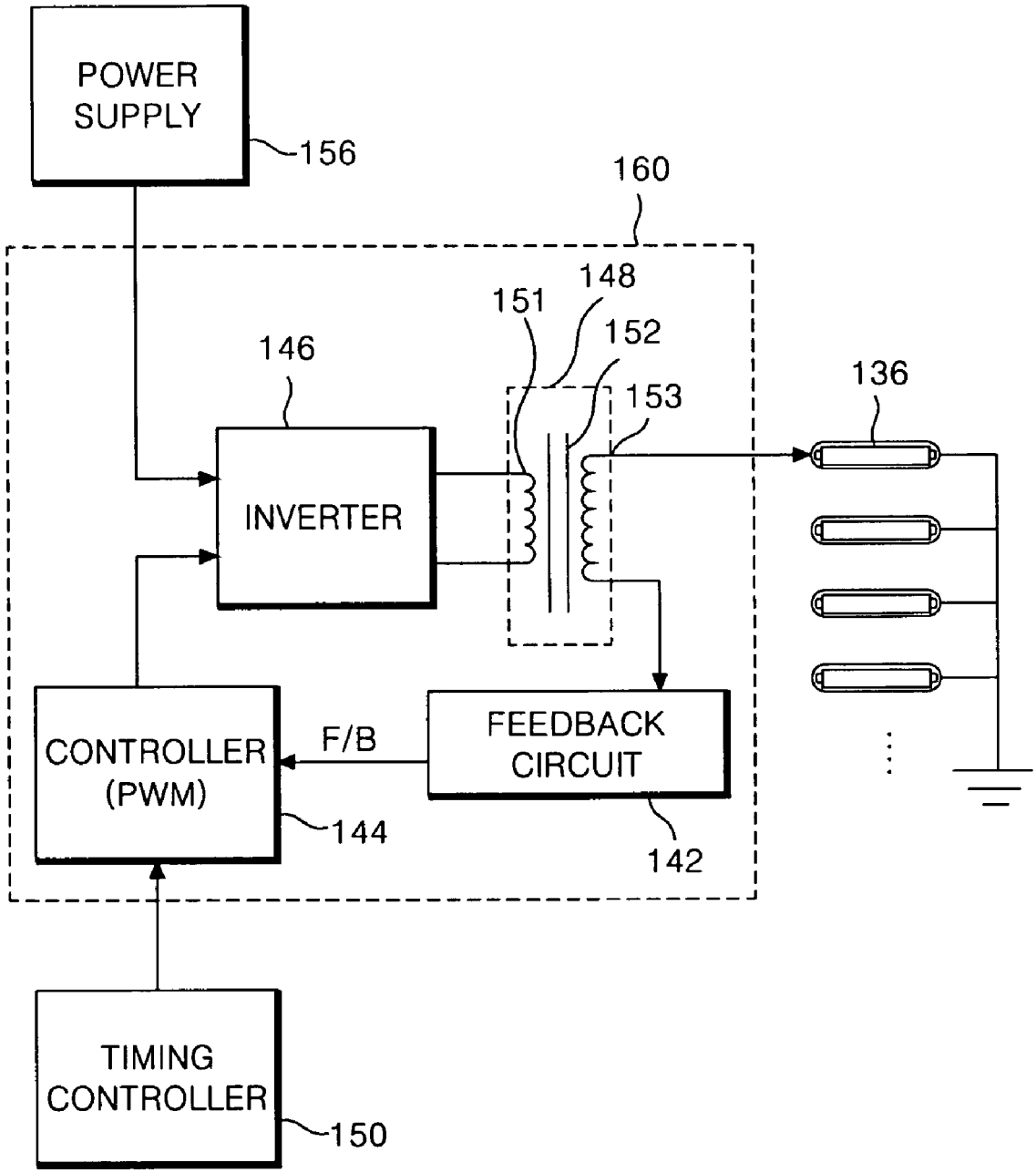
FIG. 6 is a block diagram showing a lamp driver of the liquid crystal display device according to the first embodiment of the present invention.

The lamp driver 160, as shown in FIG. 6, includes an inverter 146 to receive power from a power source 156 and to convert it into an AC waveform; a transformer 148 arranged between the inverter 146 and one end of the lamp 136 to boost the AC waveform generated from the inverter 146; a feedback circuit 142 arranged between the transformer 148 and one end of the lamp 136 to inspect a tube current supplied from the transformer 148 to the lamp 136 and to generate a feedback signal F/B accordingly; and a pulse width modulation (hereinafter, referred to as "PWM") controller 144 arranged between the inverter 146 and the feedback circuit 142 to receive the feedback signal F/B and to generate a pulse signal that converts the AC waveform generated from the inverter 146.

The inverter 146 converts the voltage supplied from the voltage source into the AC waveform by use of a switch device that is switched by the pulse generated from the PWM controller 144. The AC voltage formed in this way is transmitted to the transformer 148.

The transformer 148 boosts the AC waveform supplied from the inverter 146 to an AC waveform of high voltage in order to drive the lamp 136. For this end, a primary winding 151 of the transformer 148 is connected to the inverter 146, a secondary winding 153 is connected to the feedback circuit 142, and an auxiliary winding 152 is arranged therebetween. The auxiliary winding induces the voltage of the primary winding 151 to the secondary winding 153. The AC waveform supplied from the inverter 146 by the winding ratio between the primary winding 151 and the secondary winding 153 is boosted to the AC waveform of high voltage to be induced to the secondary winding 153 of the transformer 148. The waveform of high voltage boosted in this way is supplied to one end of the lamp 136.

The feedback circuit 142 detects the current transmitted to the lamp 136 by the AC high voltage induced to the secondary winding 153 to generate the feedback signal F/B. The feedback circuit 142 may be located at the output terminal of the lamp 136, and detects the output value outputted from the lamp 136 located at the output terminal.

The PWM controller 144 receives the feedback of the tube current flowing in the lamp 136 to control the switching of the switch device. Each of the PWM controllers 144 controls the switching of the switch device of the inverter 146 to change the AC waveform.

Figure 7:
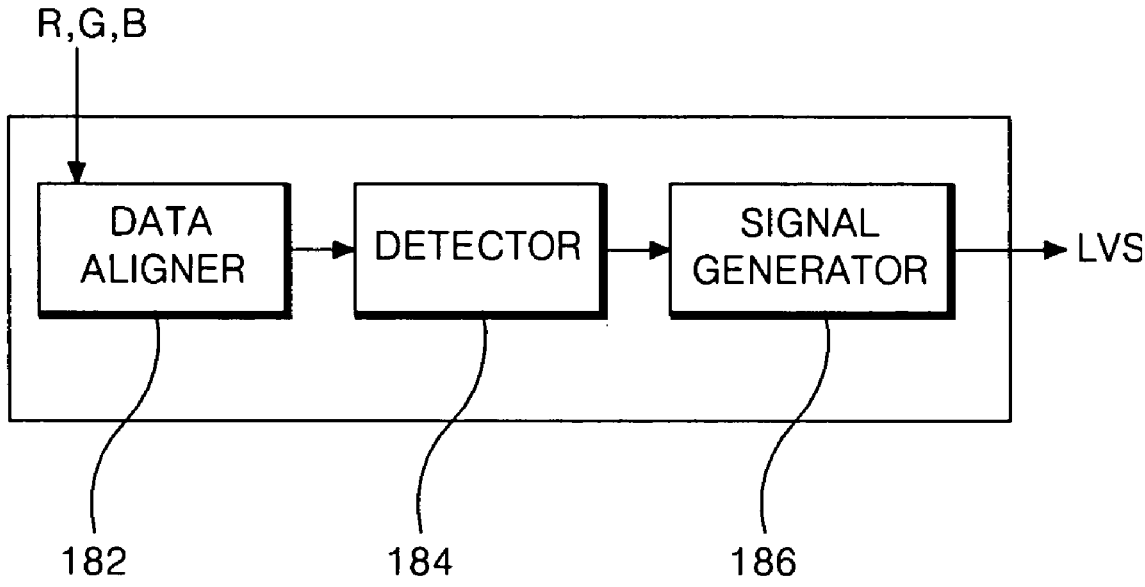
FIG. 7 is a block diagram showing a timing controller according to the present invention.

The timing controller 150, as shown in FIG. 7, includes: a data aligner 182 to align data transmitted from the exterior; a detector 184 to determine a brightness of data; and a signal generator 186 to generate a brightness variation signal having an on-time period and an off-time period in accordance with the brightness determined by the detector 184.

The data aligner 182 re-arranges digital video data supplied from a digital video card (not shown) in red R, green G and blue B color unit.

The detector 184 detects a specific brightness value in accordance with the data from the digital video data of the re-arranged red R, green G, and blue B colors.

The signal generator 186 generates a brightness variation signal LVS for increasing a brightness of an area of the liquid crystal display panel 102 corresponding to the digital video data having the brightness value detected from the detector 184.

A method of driving the lamp driver 160 of the liquid crystal display device according to the first embodiment of the present invention having such a structure will be described.

The lamp driver 160 of the liquid crystal display device according to the first embodiment of the present invention can have various systems for controlling a brightness generated from each lamp 136. These systems include a burst mode system, a linear mode system and a mixed type of the burst mode and the linear mode system. In the burst mode system, the brightness variation signal LVS, applied from the timing controller 150, is supplied to the PWM controller 144 and a duty ratio of a pulse generated from the PWM controller 144 is changed. In the linear mode system, an amplitude of the pulse signal generated from the PWM controller 144 is changed.

Figure 8:
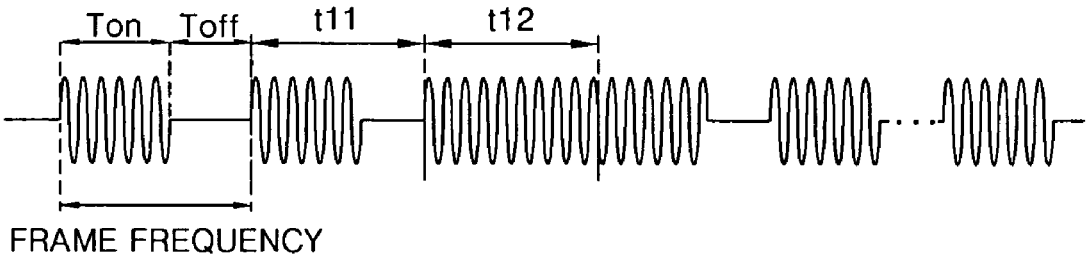
FIG. 8 is a configuration showing a waveform of a burst mode according to the first embodiment of the present invention.

In the burst mode system shown in FIG. 8, the duty ratio of the pulse signal generated from the PWM controller 144 in accordance with the brightness variation signal LVS of the timing controller 150 is changed. More specifically, if a pulse signal is supplied from the PWM controller 144 to the inverter 146 during the t11 interval, then a switching device included in the inverter 146 performs a switching during the on-time Ton period of the pulse signal of the t11 interval to thereby convert a direct current voltage, applied from the power source, into an AC waveform. Switching of the switching device is turned-off during the off-time Toff period of the pulse signal so that the AC waveform is not formed. Such an AC waveform is boosted while passing through the transformer 148, and then the boosted AC waveform is supplied to the lamp 136, to thereby generate light.

During the t12 interval, if the pulse signal is supplied from the PWM controller 144 to the inverter 146, then the switching device included in the inverter 146 performs a switching during the on-time Ton period of the pulse signal of the t12 interval. Compared with the t11 interval, as the switching time of the inverter 146 increases in the t12 interval, the AC waveform of the t12 interval generated from the inverter 146 is longer than the AC waveform of the t11 interval. Accordingly, the AC waveform boosted while passing through the transformer 148 is supplied to the lamp 136, so that light is generated. The generated light generates a relatively brighter brightness as compared to the brightness of the lamp generated in the t11 interval.

Figure 9:
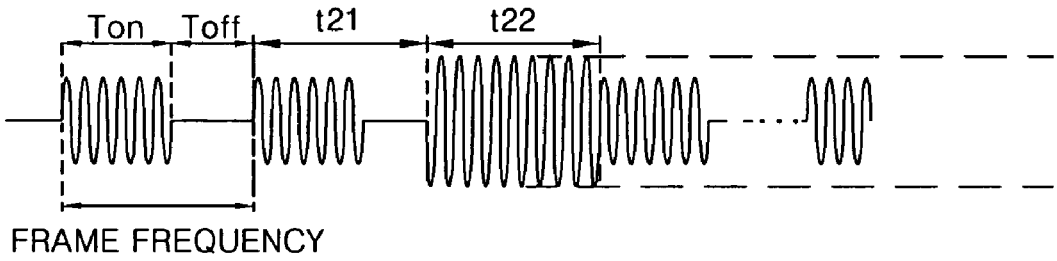
FIG. 9 is a configuration showing a waveform of a linear mode according to the first embodiment of the present invention.

In the linear mode system shown in FIG. 9, the amplitude of the pulse signal generated from the PWM controller 144 in accordance with the brightness variation signal LVS of the timing controller 150 is changed. More specifically, if a pulse signal is supplied from the PWM controller 144 to the inverter 146 during the t21 interval, then a switching device included in the inverter 146 performs a switching during the on-time Ton period of the pulse signal of the t21 interval to thereby convert a direct current voltage, applied from the power source, into an AC waveform. Switching of the switching device is turned-off during the off-time Toff period of the pulse signal so that the AC waveform is not formed. Such an AC waveform is boosted while passing through the transformer 148, and then the boosted AC waveform is supplied to the lamp 136, to thereby generate light.

During the t22 interval, if the pulse signal is supplied from the PWM controller 144 to the inverter 146, then the switching device included in the inverter 146 performs a switching corresponding to the amplitude of the pulse signal shown in t22 during the on-time Ton period of the pulse signal of the t22 interval so that a relatively larger amplitude AC waveform is formed compared to the AC waveform generated during the t21 interval. Such an AC waveform is boosted while passing through the transformer 148, and then the boosted AC waveform is supplied to the lamp 136, to thereby generate light. The generated light has a relatively larger brightness compared to the light generated from the lamps during the t21 interval.

Figure 10:
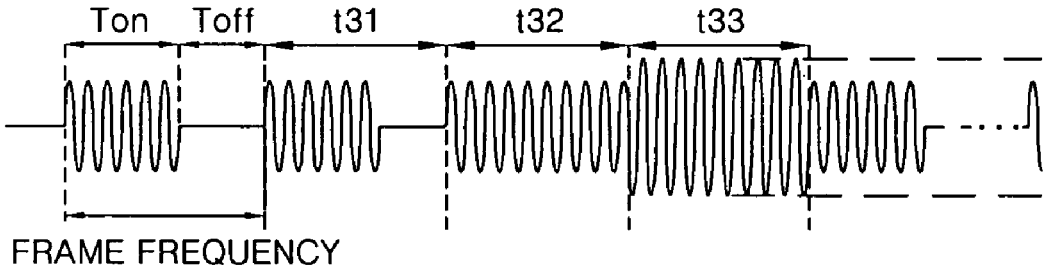
FIG. 10 is a configuration showing a waveform of a mixed type of the burst mode and the linear mode according to the first embodiment of the present invention.

In the mixed type of the burst mode and the linear mode shown in FIG. 10, the amplitude of the pulse signal generated from the PWM controller 144 in accordance with the brightness variation signal LVS of the timing controller 150 is changed. More specifically, if a pulse signal is supplied from the PWM controller 144 to the inverter 146 during the t31 interval, then a switching device included in the inverter 146 performs a switching corresponding to the period and the amplitude of the pulse signal shown in the t31 interval during the on-time Ton period of the pulse signal of the t21 interval to thereby convert a direct current voltage, applied from the power source 156, to an AC waveform. During the off-time Toff period of the pulse signal, the switching of the switching device is turned-off so that the AC waveform is not formed. Such an AC waveform is boosted while passing through the transformer 148, and then the boosted AC waveform is supplied to the lamp 136, to thereby generate light.

During the t32 interval, if the pulse signal is supplied from the PWM controller 144 to the inverter 146, then the switching device included in the inverter 146 performs a switching corresponding to the period and the amplitude of the pulse signal shown in t32. In this connection, during the off-time Toff period of the pulse signal, the switching of the switching device is turned off so that the AC waveform is not formed. During the on-time Ton period of the pulse signal, a direct current voltage, applied from the power source 156, is converted into an AC waveform. To compare this to the t31 interval, in the t32 interval, the lamp 136 is driven by the above-mentioned burst mode system so that the t32 interval has a relatively brighter brightness than that of the t31 interval.

Further, if a pulse signal is supplied from the PWM controller 144 to the inverter 146 during the t33 interval, then a switching device included in the inverter 146 performs a switching corresponding to the period and the amplitude of the pulse signal shown in the t33 interval to thereby convert a direct current voltage, applied from the power source 156, into an AC waveform. To compare this to the t31 interval and the t32 interval, in the t33 interval, the lamp 136 is driven by the above-mentioned burst mode system and the linear mode system so that the t33 interval has a relatively brighter brightness than that of the t31 interval and the t32 interval.

As a result, the burst mode system and the linear mode system are associated to the on-time Ton and the off-time Toff of the brightness variation signal LVS generated from the timing controller, so that the brightness of light generated from the lamp 136 is variously represented.

Figure 11:
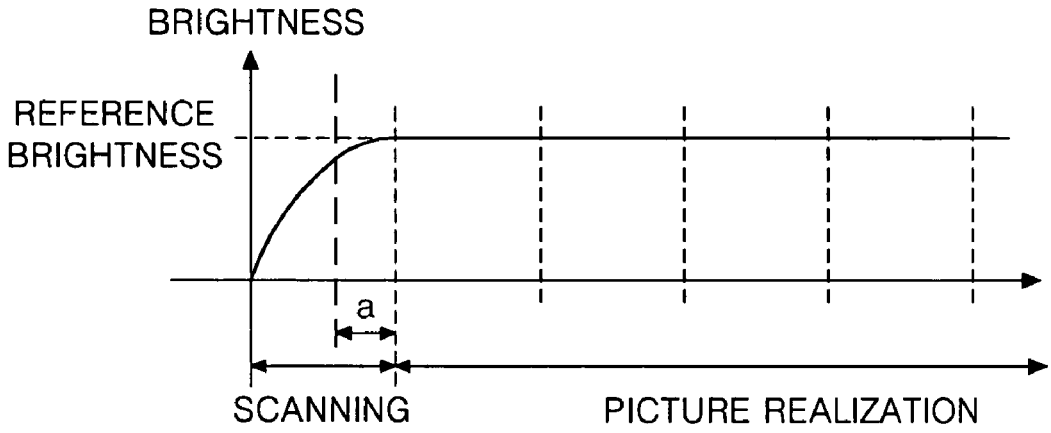
FIG. 11 is a graph showing a scanning section of the liquid crystal display panel according a second embodiment of the present invention.

FIG. 11 is a waveform diagram representing a method for driving a liquid crystal display device according to a second embodiment of the present invention.

Referring to FIG. 11, the lamp driver 160 of the liquid crystal display device according to the second embodiment of the present invention includes a scanning period and a picture implementing period.

During the scanning period, since similar gray levels are integrated in a moving picture, a scanning technique is used to reduce blur that deteriorates the picture quality. Since the liquid crystal material $CL_c$ is supplied with a power source to be activated, accordingly a delay time is generated. However, the delay times differ dependent on the characteristics of the liquid crystal material used in the display. These characteristics include the type and thickness of the liquid crystal material used. Accordingly, before implementing a picture, a scanning period is used to compensate for the delay time of the liquid crystal material by supplying a voltage to the liquid crystal material to uniformly activate the liquid crystal display in advance. Further, the scanning period determines a point of time to implement the picture to the liquid crystal material. In the "a" section shown in FIG. 11, the liquid crystal material $CL_c$ is activated and provides less than a specific reference brightness value during the scanning period. This period is substantially less than the amount of time in which a user can distinguish the change. In other words, a picture can be implemented to the liquid crystal display panel even when using the "a" section.

Such a scanning period can stably provide a regular brightness by associating the above-mentioned burst mode with the linear mode. During the scanning period, the lamp driver 160 of the liquid crystal display device according to the second embodiment of the present invention allots a value corresponding to the specific reference brightness, that is, a normal brightness (e.g., 500 nt), in accordance with the character of the liquid crystal display panel. Accordingly, after determining a specific output power, a duty ratio and an amplitude of the pulse of the PWM controller 144 corresponding to the determined specific output power is adjusted. The normal brightness may be determined by an experimental result and a statistical result in accordance with the characteristics of the liquid crystal display panel.

For example, when the on-time duty ratio of the pulse generated from the PWM controller 144 is small, a tube current generated from the inverter 146 to supply the lamp 136 is correspondingly small. Accordingly, the brightness of the light generated from the lamp 136 is relatively reduced compared to the predetermined normal brightness. To compensate for this, the duty of the on-time is not changed and the amplitude of the pulse during the on-time is increased to correspond to the normal brightness, so that the brightness of the light generated from the lamp 136 can be compensated to correspond to the normal brightness.

In another example, when the on-time duty ratio of the pulse generated from the PWM controller 144 is large, a tube current generated from the inverter 146 to supply the lamp 136 is correspondingly large. Accordingly, the light generated from the lamp 136 has a larger brightness value than the predetermined normal brightness. To compensate for this, the amplitude of the on-time pulse is set small. As a result, the brightness of the light generated from the lamp 136 can be compensated to correspond to the normal brightness.

The lamp driver 160 of the liquid crystal display device driven by the system mentioned in the first and the second embodiments of the present invention is used for various types of lamps. For instance, the lamp driver arranges lamps of "U" shape in parallel in a double line to sequentially enable turn-on and turn-off. In this system, the lamp driver can drive a lamp of "L" shape, a linear shape lamp, a ring shape lamp, a circle shape lamp and the like singly or in a group. Accordingly, the present invention is not limited to the lamp shape.

As described above, the lamp driver of the liquid crystal display device according to the embodiment of the present invention is possible to adjust the strength of the current and the voltage supplied to the lamp by associating the period and the amplitude of the pulse signal generated from the PWM controller to change them in various manners. Accordingly, the lamp driver of the liquid crystal display device according to the embodiment of the present invention flexibly adjusts the brightness of the lamp to correspond to each picture implemented in the liquid crystal display panel. As a result, the lamp driver of the liquid crystal display device according to the embodiment of present invention is possible to improve the picture quality of the liquid crystal display panel.

Moreover, the lamp driver of the liquid crystal display device according to the embodiment of the present invention is possible to freely alter the duty ratio of the scanning to be suitable to liquid crystal display panels having different characteristics. For example, even through a specific duty ratio may be used, the lamp driver can adjust the amplitude to identically maintain the entire brightness to thereby stably provide the brightness generated from the lamps.

In addition, the lamp driver of the liquid crystal display device reduces power consumption since the lamps are driven by a division driving system that sequentially turns on and turns off. Further, it is possible to improve the brightness of the liquid crystal display panel by using various lamps, that is, a lamp of "S" shape, a lamp of "L" shape, a linear shape lamp, a ring shape lamp, a circle shape lamp and the like.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An apparatus for driving a lamp of a liquid crystal display device comprises:

a plurality of lamps to irradiate light to a liquid crystal display panel;

a lamp driver supplying a high voltage alternating current (AC) signal to, and controlling brightness of the plurality of lamps of the liquid crystal display panel, wherein the lamp driver comprises:

an inverter to receive: an external direct current (DC) signal and a pulse generated from a Pulse Width Modulator controller, wherein the inverter converts the external direct current signal into the high voltage alternating current signal, wherein the Pulse Width Modulator controller controls and adjusts based on a feedback signal, at least one of a duty cycle ratio and an amplitude of the high voltage alternating current signal to correspond to a specified reference brightness in accordance with a characteristic of the liquid crystal display panel during a scanning period, wherein the scanning period is prior to a picture implementing period; and a timing controller to generate a brightness variation signal based on a brightness determination of input video signal, and supplies the brightness variation signal to the Pulse Width Modulator controller during the picture implementing period, wherein the brightness variation signal causes the Pulse Width Modulator controller to adjust the at least one of the duty cycle ratio and the amplitude of the high voltage alternating current signal based on a high and a low brightness of a picture implemented by the liquid crystal display panel:

wherein during the scanning period, the lamp driver allots a value corresponding to a specific reference brightness in accordance with the characteristic of the liquid crystal display panel, wherein the apparatus compensates for a delay time within the scanning period by supplying a voltage to a liquid crystal material to uniformly activate the liquid crystal display panel in advance, wherein during the scanning period, if the on-time duty cycle ratio of the pulse generated from the Pulse Width Modulator controller is small or the on-time duty cycle ratio of the pulse is unchanged, increase the amplitude of the pulse to correspond to the specific reference brightness, and if the on-time duty cycle ratio of the pulse is large, decrease the amplitude of the pulse, wherein the specific reference brightness is determined by an experimental result and a statistical result in accordance with the characteristic of the liquid crystal display panel, wherein the brightness of the lamp can be compensated to correspond to the specific reference brightness, wherein during the scanning period, after determining a specific output power in accordance with the specific reference brightness, adjust the amplitude of the pulse of the Pulse Width Modulator controller to correspond to the determined specific output power, and wherein during the scanning period, if the on-time duty cycle ratio of the pulse is unchanged, adjust the amplitude of the pulse to correspond to the determined specific output power.

2. The apparatus according to claim 1, wherein the inverter alternately repeats an on-period and an off-period of the alternating current signal corresponding to the brightness of the variation signal generated from the timing controller.

3. The apparatus according to claim 2, wherein the brightness of each lamp is controlled to correspond to the high voltage alternating current signal.

4. A method of driving a lamp of a liquid crystal display device, the method comprising:

setting at least one of a duty cycle ratio and an amplitude of an alternating current (AC) signal supplied to the lamp in accordance with a reference brightness of a liquid crystal display panel during a scanning period before a picture implementing period of the liquid crystal display panel; and adjusting based on a feedback signal, the at least one of the amplitude and the duty cycle ratio of the alternating current signal in accordance with the duty cycle ratio and the amplitude determined during the scanning period;

generating a brightness variation signal during the picture implementing period based on a high and a low brightness of a picture implemented by the liquid crystal display panel;

generating a control signal in accordance with the brightness variation signal, generating an alternating current waveform corresponding to the control signal; and generating light by supplying the alternating current waveform to the lamp to irradiate the light to the liquid crystal display panel, wherein the generation of the brightness variation signal in accordance with the high and low brightness of the picture implemented by the liquid crystal display panel includes generating the brightness variation signal corresponding to video data input from external to the liquid crystal display panel, wherein the generation of the control signal in accordance with the brightness variation signal includes at least one of adjusting a duty cycle ratio of the brightness variation signal and adjusting an amplitude of the brightness variation signal, wherein the generation of the alternating current waveform corresponding to the control signal includes at least one of adjusting an on-time period of the alternating current waveform if the duty cycle ratio of the control signal is changed, and adjusting the amplitude of the alternating current waveform if the amplitude of the control signal is changed, wherein during the scanning period, the lamp driver allots a value corresponding to a specific reference brightness in accordance with a characteristic of the liquid crystal display panel, wherein the apparatus compensates for a delay time within the scanning period by supplying a voltage to a liquid crystal material to uniformly activate the liquid crystal display panel in advance, wherein during the scanning period, if the on-time duty cycle ratio of the pulse generated from the Pulse Width Modulator controller is small or the on-time duty cycle ratio of the pulse is unchanged, increase the amplitude of the pulse to correspond to the specific reference brightness, and if the on-time duty cycle ratio of the pulse is large, decrease the amplitude of the pulse, wherein the specific reference brightness is determined by an experimental result and a statistical result in accordance with the characteristic of the liquid crystal display panel, wherein the brightness of the lamp can be compensated to correspond to the specific reference brightness, wherein during the scanning period, after determining a specific output power in accordance with the specific reference brightness, adjust the amplitude of the pulse of the Pulse Width Modulator controller to correspond to the determined specific output power, and wherein during the scanning period, if the on-time duty cycle ratio of the pulse is unchanged, adjust the amplitude of the pulse to correspond to the determined specific output power.

5. The method according to claim 4, wherein the setting of the at least one of the duty ratio and the amplitude of the AC signal supplied to the lamp in accordance with the reference brightness is determined in accordance with characteristics of liquid crystal material injected to the liquid crystal display panel.

6. The method according to claim 5, wherein the generation of light by supplying the alternating current waveform to the lamp to irradiate the light to the liquid crystal display panel includes:

supplying an adjusted tube current and an adjusted alternating current voltage to the lamp to generate light to achieve a particular brightness, wherein the adjusted tube current and the adjusted alternating current voltage correspond to at least one of the adjusted on-time period of the alternating current waveform and the adjusted amplitude of the alternating current waveform; and generating light from the lamp in accordance with a brightness of video data input from external to the liquid crystal display panel to sequentially irradiate the light to the liquid crystal display panel during the picture implementing period.

7. The method according to claim 4, wherein the liquid crystal display panel comprises a plurality of lamps, and the method further comprising adjusting at least one of an amplitude and a duty cycle ratio of an alternating current signal supplied to each of the lamps in accordance with a duty cycle ratio and an amplitude determined during the scanning period.

8. The method according to claim 7, further comprising determining the reference brightness experimentally based on characteristics of the liquid crystal material in the liquid crystal display panel.

9. The method according to claim 7, comprising setting the scanning period to be longer than a delay time of the liquid crystal material in the liquid crystal display to activate the liquid crystal material to transmit light.

10. The method according to claim 7, comprising setting the scanning period to be less than an amount of time in which a viewer of the liquid crystal display can distinguish a change in brightness of the liquid crystal display.

11. The method according to claim 7, comprising, during the picture implementing period for each lamp:

generating a brightness variation signal in accordance with a high and a low brightness of the picture;

generating a control signal in accordance with the brightness variation signal;

generating an alternating current waveform corresponding to the control signal; and supplying the alternating current waveform to the lamp to generate light.

12. The method according to claim 11, wherein the generation of the control signal in accordance with the brightness variation signal includes at least one of:

adjusting a duty cycle ratio of the brightness variation signal; and adjusting an amplitude of the brightness variation signal.

13. The method according to claim 12, wherein the generation of the alternating current waveform corresponding to the control signal includes at least one of:

adjusting an on-time period of the alternating current waveform if the duty cycle ratio of the control signal is changed; and adjusting the amplitude of the alternating current waveform if the amplitude of the control signal is changed.

14. A method of driving a plurality of lamps in a liquid crystal display device, the method comprising performing within each lamp:

establishing a picture implementing period in which a picture is implemented by the liquid crystal display device and a scanning period before the picture implementing period, the scanning period being substantially less than the picture implementing period;

determining an amount of power to be supplied to the lamp to establish a reference brightness;

adjusting based on a feedback signal, at least one of an amplitude and a duty cycle ratio of an alternating current (AC) signal supplied to the lamp to establish the reference brightness during the scanning period, generating a brightness variation signal during the picture implementing period based on a high and a low brightness of a picture implemented by the liquid crystal display panel;

generating a control signal in accordance with the brightness variation signal, generating an alternating current waveform corresponding to the control signal; and generating light by supplying the alternating current waveform to the lamp to irradiate the light to the liquid crystal display panel, wherein the generation of the brightness variation signal in accordance with the high and low brightness of the picture implemented by the liquid crystal display panel includes generating a brightness variation signal corresponding to video data input from external to the liquid crystal display panel, wherein the generation of the control signal in accordance with the brightness variation signal includes at least one of adjusting a duty cycle ratio of the brightness variation signal and adjusting an amplitude of the brightness variation signal, wherein the generation of the alternating current waveform corresponding to the control signal includes at least one of adjusting an on-time period of the alternating current waveform if the duty cycle ratio of the control signal is changed and adjusting the amplitude of the alternating current waveform if the amplitude of the control signal is changed, wherein during the period before a picture implementing period, the lamp driver allots a value corresponding to a specific reference brightness in accordance with the characteristic of the liquid crystal display panel, wherein during the scanning period, the lamp driver allots a value corresponding to a specific reference brightness in accordance with the high and the low brightness characteristic of the liquid crystal display panel, wherein the apparatus compensates for a delay time within the scanning period by supplying a voltage to a liquid crystal material to uniformly activate the liquid crystal display panel in advance, wherein during the scanning period, if the on-time duty cycle ratio of the pulse generated from the Pulse Width Modulator controller is small or the on-time duty cycle ratio of the pulse is unchanged, increase the amplitude of the pulse to correspond to the specific reference brightness, and if the on-time duty cycle ratio of the pulse is large, decrease the amplitude of the pulse, wherein the specific reference brightness is determined by an experimental result and a statistical result in accordance with the characteristics of the liquid crystal display panel, wherein the brightness of the lamp can be compensated to correspond to the specific reference brightness, wherein during the scanning period, after determining a specific output power in accordance with the specific reference brightness, adjust the amplitude of the pulse of the Pulse Width Modulator controller to correspond to the determined specific output power, and wherein during the scanning period, if the on-time duty cycle ratio of the pulse is unchanged, adjust the amplitude of the pulse to correspond to the determined specific output power.

* * * * *